US005171160A

United States Patent [19]

Beins et al.

[11] Patent Number: 5,171,160

[45] Date of Patent: Dec. 15, 1992

[54] PRINTED CIRCUIT BOARD CLAMPING ASSEMBLY

[75] Inventors: Eckhard Beins, Detmold; Uwe Fiene, Steinheim; Walter Landwehrmann, Bielefeld; Thomas Uth, Paderborn; Manfred Wilmes, Detmold; Michael Schnatwinkel, Herford; Klaus Strate, Detmold, all of Fed. Rep. of Germany

[73] Assignee: C.A. Weidmüller GmbH & Co., Fed. Rep. of Germany

[21] Appl. No.: 786,764

[22] Filed: Nov. 1, 1991

[30] Foreign Application Priority Data

Nov. 2, 1990 [DE] Fed. Rep. of Germany ..... 4034789

[51] Int. Cl.[5] ..... H01R 13/62

[52] U.S. Cl. ..... 439/329; 439/801; 439/78

[58] Field of Search ..... 439/55, 78, 79, 80, 439/82, 329, 571, 572, 715, 725, 727, 728, 751, 801, 810, 811, 812

[56] References Cited

U.S. PATENT DOCUMENTS 3,409,857 11/1968 O'Neill et al. ..... 439/72
3,904,266 9/1975 Fitzpatrick .
4,171,152 10/1979 Geiseler ..... 439/811 X
4,219,251 8/1980 Romine ..... 439/801 X
4,435,031 3/1984 Black et al. ..... 439/82

FOREIGN PATENT DOCUMENTS 8433087.2 6/1986 Fed. Rep. of Germany .

OTHER PUBLICATIONS

Electronik Journal 17/87 pp. 62, 64.

*Primary Examiner*—Larry I. Schwartz
*Assistant Examiner*—Khiem Nguyen
*Attorney, Agent, or Firm*—Laubscher & Laubscher

[57] ABSTRACT

A circuit board clamping assembly is characterized by connector pins (3) for the connection of the circuit board clamp to the circuit board. The clamping assembly furthermore has at least one mounting peg (8) that can be inserted in a corresponding mounting opening of the circuit board. The additional mounting peg facilitates the reliable absorption of forces, such as occur during wiring, at the conductor connections (2, 2*a*) of the clamping assembly and guarantees a reliable mechanical link between the clamping assembly and printed circuit board.

2 Claims, 1 Drawing Sheet

PRINTED CIRCUIT BOARD CLAMPING ASSEMBLY

BACKGROUND OF THE INVENTION

The present invention relates to an electrical conductor clamping assembly for use in connection with a printed circuit board wherein the assembly is mounted and electrically connected with the board via a press-fit mounting arrangement.

BRIEF DESCRIPTION OF THE PRIOR ART

Printed circuit board clamping devices are known in the patented prior art as evidenced by U.S. Pat. No. 3,904,266. In the device disclosed therein, the connection pins for the electrical connection between the paths of the circuit board and the electrical conductor connection in the terminal clamp are made especially for soldering but also for wrap and plug connection. This makes the structure relatively complicated. Assembly is also complicated on account of the requirement for screwing for a secure connection.

In fastening plug connector bars on printed circuit boards, it is also known to provide on the back of the plug connector housing several downwardly directed pins that increase the strength of the mechanical connection between the printed circuit board and the plug connector as shown in DE 84 33 08701. There are no special requirements for the design of this mechanical connection because wiring or the like need not be done on the plug connector bars after connection with the printed circuit board and because activation of the electrical contact is also possible without any major expenditure of force.

It is also known in printed circuit technology that circuit board components can be mounted on circuit boards without soldering the electrical connections by using a press-in connection. This makes assembly of the boards much simpler. With the press-in technique the components to be connected with the board have spigots or protrusions as connection pins for which the printed circuit board is provided with metallized boreholes. However, press-in techniques have thus far only been used in conjunction with plug connectors. These techniques provide good electrical contact but poor mechanical connection with the board at each pin. This is normally not a problem because there are a plurality of pins which cumulatively afford an adequate mechanical connection with the board. Furthermore, once the plug connector is attached to the board, no further wiring or other operations are necessary which could generate forces which might jar the connector from the board.

With printed circuit connectors which are unipolar or which have only a small number of poles, there is the problem that operation of the clamping screw during the connection of the conductors generates considerable mechanical forces which must be absorbed by the mechanical connection between the clamping assembly and the printed circuit board.

The present invention was developed to create a printed circuit board camping arrangement of the type involved which will ensure a particularly simple, and solder or screw-free assembly of the printed circuit board clamps on the board with the required electrical connection and also high mechanical reliability.

SUMMARY OF THE INVENTION

Accordingly, it is a primary object of the present invention to provide an electrical clamping assembly for use on a printed circuit board which includes a housing, at least one electrical conductor connector arranged in the housing and at least connector pin connected with the conductor connector and protruding from the housing. The pin has an enlarged press-fit zone for mating connection with a metallized opening in the circuit board. The clamping assembly further includes at least one mounting peg which extends from the housing in spaced parallel relation with the connector pin beyond the press-fit zone thereof for insertion into a mounting opening contained in the circuit board. When the connector pin and the mounting peg are simultaneously inserted into the circuit board metallized opening and mounting opening, respectively, to mount the clamping assembly on the circuit board, the mounting peg engages the circuit board prior to the pin press-fit zone in order to positively guide the press-fit zone into engagement with the metallized opening. Accordingly, any possibility of the clamping assembly tilting during the press-fit connection is eliminated.

According to a preferred embodiment of the invention, one mounting peg is provided for each connector pin to insure that even in the case of printed circuit board clamping assemblies with a somewhat larger number of poles, subsequent wiring can be done at every pole without danger of dislodging the assembly.

According to another object of the invention, the housing includes a protruding catch which is arranged adjacent each connector pin to firmly connect the pin with the housing.

BRIEF DESCRIPTION OF THE FIGURES

Other objects and advantages of the invention will become apparent from a study of the following description when viewed in the light of the accompanying drawing, in which.

DETAILED DESCRIPTION

Figure 1:
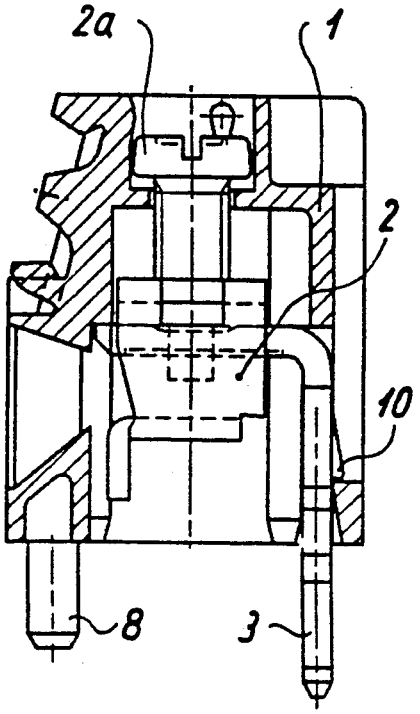
FIG. 1 is a side sectional view of the circuit board clamping assembly according to the invention.
Figure 2:
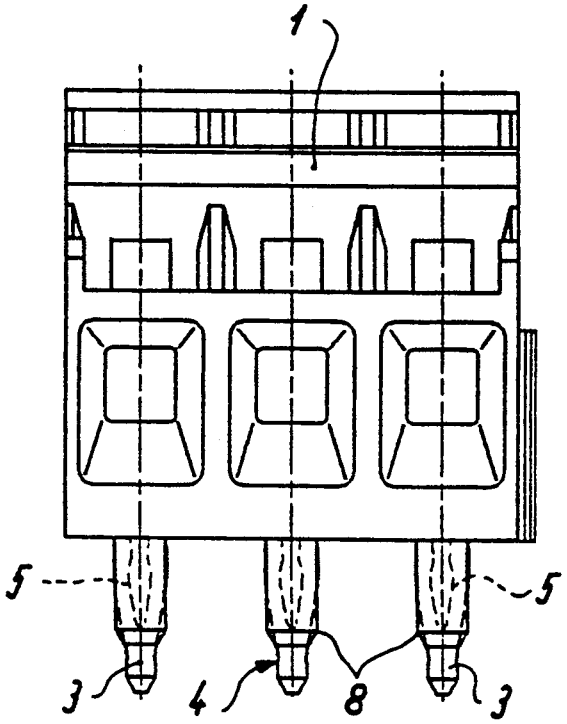
FIG. 2 is a front plan view of the circuit board clamping assembly of FIG. 1.

In the example shown in FIGS. 1 and 2, there is shown a three pole printed circuit board clamping assembly of the invention. The assembly could also have less poles or more poles or even be unipolar.

The printed circuit board clamping assembly according to FIGS. 1 and 2 has a housing 1 made of an insulating synthetic plastic material in which there are located three conductor connections 2 for connection of the incoming electrical conductors. The conductor connections 2 each have a clamping screw 2*a* which, when tightened, will connect the inserted conductor. From each conductor connection 2, a connector pin 3 leads to and protrudes from the underside of the housing 1. They are formed as spigots with hollow interiors and on their free end they have a tapering introduction zone 4 and above it, adjoining the underside of housing 1, a press-fit zone 5.

Figure 3:
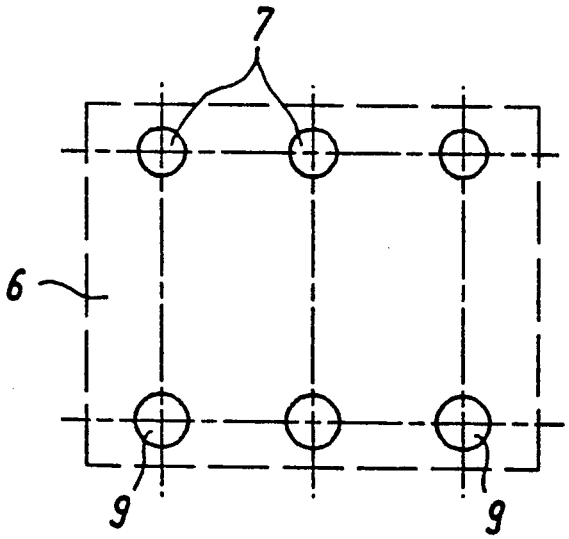
FIG. 3 is a partial top plan view of the area of a printed circuit board for receiving the clamping assembly of FIGS. 1 and 2.

In the circuit board 6 shown in FIG. 3 there is a grid of metallized openings or holes 7 into which the connector pins 3 are pressed to form electrical contact and a rigid mechanical hold.

In the example shown in the drawing, the circuit board clamping assembly is provided with three mounting pegs 8 which extend from the bottom of the housing. Thus, according to the preferred embodiment, there is one mounting peg for each connector pin. The mutually associated pins and pegs are aligned as shown in FIG. 2. Alternatively, it is conceivable to provide a two-pole clamping assembly with only one mounting peg or in case of a four-pole clamp, to provide only three mounting pegs.

The circuit board 6 contains a corresponding grid of mounting openings 9 for receiving the mounting pegs. After connection of the clamping assembly to the circuit board, any wiring done on the clamp or operation of the clamping screw 2*a* during connection of a conductor will generate forces between the clamping assembly and the board. These forces are distributed through the connector pins and the mounting pegs in a manner to prevent wedging, tilting or twisting of the clamping assembly relative to the board. The press-fit connection is maintained therebetween.

The mounting pegs 8 are configured in terms of shape, length, and diameter to prevent tilting or twisting of the clamping assembly during mounting on the board using the press-fit technique. As shown in FIG. 2, the mounting pegs 8 protrude beyond the press-fit zones 5 of the connector pins. Thus, the mounting pegs engage the circuit board prior to the press-fit zones of the pins so that the pins are guided into the metallized holes by the mounting pegs engaging the mounting holes during the installation press-fit operation.

Because relatively strong forces are generated on the connector pins during the connection with the circuit board, a protruding catch 10 from the housing is provided for each pin to firmly grip the pin and prevent its displacement. The accurate guidance of the pins by the mounting pegs and the firm grip of the pins by the catches 10 prevents any breakage of the pins during assembly. Moreover, no special assembly tools are required.

What is claimed is:

1. An electrical clamping assembly for use on a printed circuit board, comprising (a) a housing;

(b) a plurality of electrical conductor connectors arranged in said housing;

(c) a plurality of clamping screws connected with said conductor connectors, respectively, for clamping incoming conductors with said connectors;

(d) a plurality of connector pins connected with said conductor connectors, respectively, each of said pins having an enlarged press-fit zone protruding the same distance from said housing for connection with a metallized opening contained in the circuit board; and (e) a plurality of mounting pegs extending from said housing in spaced parallel relation with said connector pins beyond said press-fit zones of said connector pins for insertion into mounting openings contained in the circuit board, respectively, each of said mounting pegs corresponding with one of said connector pins, whereby when said mounting pegs and connector pins are simultaneously progressively inserted into the mounting and metallized openings, respectively, to mount the clamping assembly on the circuit board, the mounting pegs engage the circuit board adjacent to said mounting openings prior to engagement of the circuit board by press-fit zones of said connector pins adjacent to said metallized openings in order to guide said connector pin press-fit zones into engagement with said metallized openings.

2. An electrical clamping assembly for use on a printed circuit board, comprising (a) a housing containing a plurality of openings in a bottom surface thereof;

(b) a plurality of electrical conductor connectors arranged in said housing;

(c) a plurality of clamping screws connected with said conductor connectors, respectively, for clamping incoming conductors with said connectors;

(d) a plurality of connector pins connected with said conductor connectors, respectively, each of said pins having an enlarged press-fit zone protruding the same distance from said housing openings for connection with a metallized opening contained in the circuit board;

(e) said housing including a plurality of catches adjacent said openings, respectively, for firmly connecting said pins with said housing; and (f) a plurality of mounting pegs extending from said housing in spaced parallel relation with said connector pins beyond said press-fit zones of said connector pins for insertion into mounting openings contained in the circuit board, respectively, each of said mounting pegs corresponding with one of said connector pins, whereby when said mounting pegs and connector pins are simultaneously progressively inserted into the mounting and metallized openings, respectively, to mount the clamping assembly on the circuit board, the mounting pegs engage the circuit board adjacent to said mounting openings prior to engagement of the circuit board by press-fit zones of said connector pins adjacent to said metallized openings in order to guide said connector pin press-fit zones into engagement with said metallized openings.

* * * * *